US007670050B2

(12) United States Patent
Haimerl et al.

(10) Patent No.: US 7,670,050 B2
(45) Date of Patent: Mar. 2, 2010

(54) PACKAGING CONTAINER CONSISTING OF A PLASTIC FILM

(75) Inventors: Rudi Haimerl, Konzell (DE); Johannes Wedi, Emsdetten (DE)

(73) Assignee: Bischof + Klein GmbH & Co. KG, Lengerich (DE)

( * ) Notice: Subject to any disclaimer, the term of this patent is extended or adjusted under 35 U.S.C. 154(b) by 813 days.

(21) Appl. No.: 10/565,638

(22) PCT Filed: Jul. 23, 2004

(86) PCT No.: PCT/EP2004/008271

§ 371 (c)(1),
(2), (4) Date: Jan. 24, 2006

(87) PCT Pub. No.: WO2005/012122

PCT Pub. Date: Feb. 10, 2005

(65) Prior Publication Data

US 2006/0188178 A1 Aug. 24, 2006

(30) Foreign Application Priority Data

Jul. 25, 2003 (DE) ..... 203 11 386 U

(51) Int. Cl.
*B65D 33/06* (2006.01)
*B65D 30/16* (2006.01)
*B65D 30/20* (2006.01)

(52) U.S. Cl. ..... 383/28; 383/14; 383/26; 383/104; 383/120

(58) Field of Classification Search ..... 383/14, 383/26, 28, 120, 104, 6, 17–21; 294/158, 294/164

See application file for complete search history.

(56) References Cited

U.S. PATENT DOCUMENTS

| | | | | |
|---|---|---|---|---|
| 3,208,492 | A * | 9/1965 | Braithwaite | 383/8 |
| 3,370,630 | A | 2/1968 | Gordon et al. | 150/12 |
| 3,801,012 | A * | 4/1974 | Thelen | 229/117.22 |
| 4,550,439 | A | 10/1985 | Peppiatt et al. | 383/8 |
| 4,583,681 | A * | 4/1986 | Neese | 229/117.22 |
| 4,905,888 | A * | 3/1990 | Suoss et al. | 229/117.22 |
| 5,026,173 | A * | 6/1991 | Jensen | 383/10 |
| 5,048,976 | A * | 9/1991 | Jung et al. | 383/10 |
| 5,186,542 | A * | 2/1993 | Seabold | 383/25 |
| 6,010,004 | A * | 1/2000 | Huckriede et al. | 206/525 |
| 6,481,183 | B1 | 11/2002 | Schmidt | |
| 6,598,784 | B2 * | 7/2003 | LaBras et al. | 229/117.22 |
| 2008/0080794 | A1 * | 4/2008 | Kruse et al. | 383/14 |

(Continued)

FOREIGN PATENT DOCUMENTS

| | | |
|---|---|---|
| AT | 242055 B | 8/1965 |

(Continued)

*Primary Examiner*—Jes F Pascua
(74) *Attorney, Agent, or Firm*—Gudrun E. Huckett

(57) ABSTRACT

A packaging container made of plastic film has a strap handle arranged within the contour of the container: The container has a container wall made of plastic film. The container wall has an inner side and the strap handle is arranged on the inner side. The container wall has an access opening through which the strap handle is accessible from the exterior of the container. A support patch made of plastic film is connected to the container wall. The access opening is closed off relative to the interior of the container by the support patch.

13 Claims, 5 Drawing Sheets

U.S. PATENT DOCUMENTS

2009/0202181 A1 * 8/2009 Alaux ..... 383/7

FOREIGN PATENT DOCUMENTS

| | | | |
|---|---|---|---|
| BR | 7001751 | U | 3/1992 |
| DE | 1 222 238 | | 8/1966 |
| DE | 2 155 091 | | 5/1972 |
| DE | 3205340 | A1 | 8/1983 |
| DE | 8428169 | U1 | 11/1984 |
| DE | 3812444 | A1 | 10/1989 |
| DE | 3925981 | A1 | 2/1991 |
| EP | 0341532 | A1 | 11/1989 |
| EP | 553693 | A2 * | 8/1993 |
| EP | 0900741 | B1 | 3/1999 |
| FR | 2 228 681 | | 12/1974 |
| FR | 2 692 868 | | 12/1993 |
| GB | 1 022 595 | | 3/1966 |
| GB | 2254065 | A | 9/1992 |

* cited by examiner

PACKAGING CONTAINER CONSISTING OF A PLASTIC FILM

BACKGROUND OF THE INVENTION

The invention relates to a packaging container made of plastic film, in particular, a bag, pouch, or the like that can be closed at its upper end, comprising a carrying handle arranged within the contour of the container.

In a known packaging container of the aforementioned kind, a corner area is separated from the interior by a heat seal seam in which corner area a grip opening is cut out. Such a configuration reduces the filling space of the packaging container and limits the possibilities for arranging the carrying handle to the corner areas in order for the carrying handle not to impair filling and emptying of the packaging container.

In bags that are open at the upper end and comprised of multi-layer material, it is known to provide handle loops that project past the upper edge of the container and are secured with their attachment ends between layers of the container wall in the upper edge area. Such a configuration of the carrying handles impairs handling of the bag because of the projecting handle loops. Such handles are moreover limited to bag or pouch configurations that do not have closure means at the upper edge.

In the case of valve bags, it is known to provide a carrying handle on the bag bottom that comprises a bottom patch supporting a strap handle. Such a carrying handle configuration is not suitable for containers that are closable at their upper edge after filling and are provided, for example, at their upper edge with an edge closure device for reclosing the bag.

The invention is concerned with the problem of providing a packaging container of the aforementioned kind with a carrying handle that can be easily attached, enables carrying of the bag in an orientation similar to a stand-up position, and that leaves open the upper edge area of the container for closing and reclosing devices.

SUMMARY OF THE INVENTION

The invention solves the problem by a packaging container made of plastic film, in particular, a bag, pouch or the like closable at its upper end, that comprises a carrying handle arranged within the contour of the container, wherein a strap handle is provided as a carrying handle which strap handle is arranged in the area of a sidewall of the container and in its upper half and is connected in the area of its two ends to the container wall. With regard to important further embodiments, reference is being had to the dependent claims.

In the container according to the invention, the strap handle is a functional part that extends across the sidewall of the container and is visually inconspicuous, that enables a comfortable carrying of the container, and that leaves open the top area of the container for closures and reclosing devices. In this connection, the carrying handle can be easily attached during manufacture. When attaching the strap handle to the inner side of the sidewall of the packaging container, the carrying handle is particularly inconspicuous visually. Inasmuch as the access opening for accessing the strap handle is initially closed and becomes exposed only after tearing open a perforated wall area, the carrying handle can even be visually entirely hidden until the bag is readied for use so that the design of the outer surface of the container sidewall can be realized without having to take into consideration the carrying handle.

Further details and effects result from the following description and the drawing in which several embodiments of the subject matter of the invention are schematically illustrated in more detail. Specifically, it is shown in:

FIG. 1 a broken away plan view onto the sidewall of a packaging container according to the invention with a strap handle arranged externally on the container sidewall and connected to the upper area of the container sidewall;

FIG. 2 a longitudinal section of the carrying handle according to FIG. 1;

FIG. 3 a plan view similar to FIG. 1 of a preferred second embodiment of a carrying handle configuration;

FIG. 4 a view similar to FIG. 3 for illustrating the carrying handle area before tearing open a wall area that is delimited by a perforation and designed for releasing the future access opening;

FIG. 5 a view similar to FIG. 4 for illustrating a third embodiment of the container according to FIG. 3;

FIG. 6 a broken-away cross-section of the carrying handle area according to FIG. 5.

DESCRIPTION OF PREFERRED EMBODIMENTS

Figure 1:
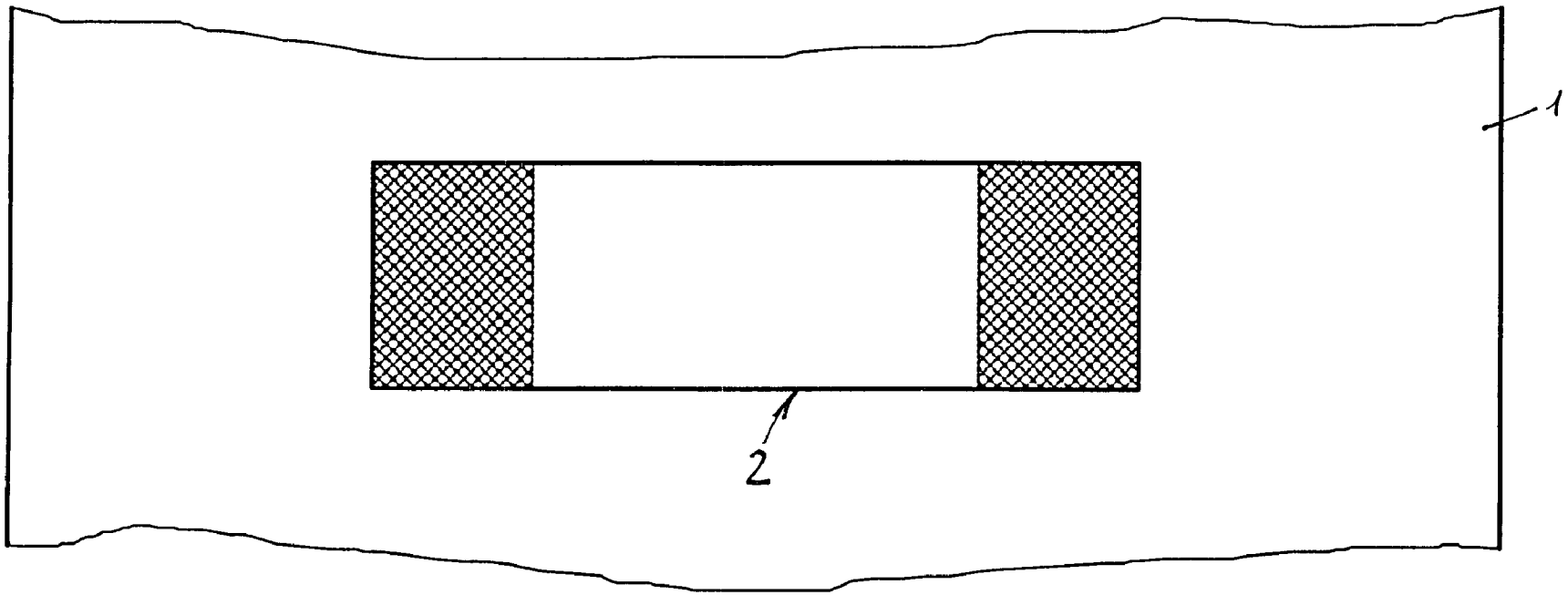
Figure 2:
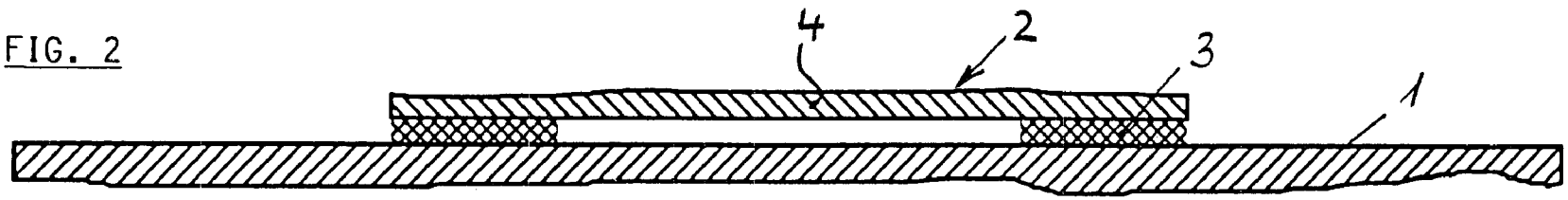

FIG. 1 illustrates in a broken-away illustration a sidewall area of a container in accordance with the present invention which is arranged expediently near the upper edge of the container. The container that is made of plastic film is preferably embodied as a flat bag or gusseted bag and is provided with a flat or shaped bottom. Preferably, the container has at its upper edge a closure device for reclosing the bag after removal of a portion of the filled-in goods.

A strap handle 2 is arranged on the front site 1 (or backside) of the container that is facing the viewer—which container can also be configured as a bag—and in the area of its two ends is connected to the container wall 1; depending on the material, it is attached by an adhesive or by sealing. When the container film, as is preferred, is comprised of polyester (PET) at least on the exterior side, the strap handle 2 is glued on by an adhesive 3. In practice, the strap handle 2 is positioned flat and flush on the exterior side of the container wall 1, but, for carrying purposes, can be lifted off the exterior side of the container wall 1 in the area of the handle loop part 4.

Figure 3:
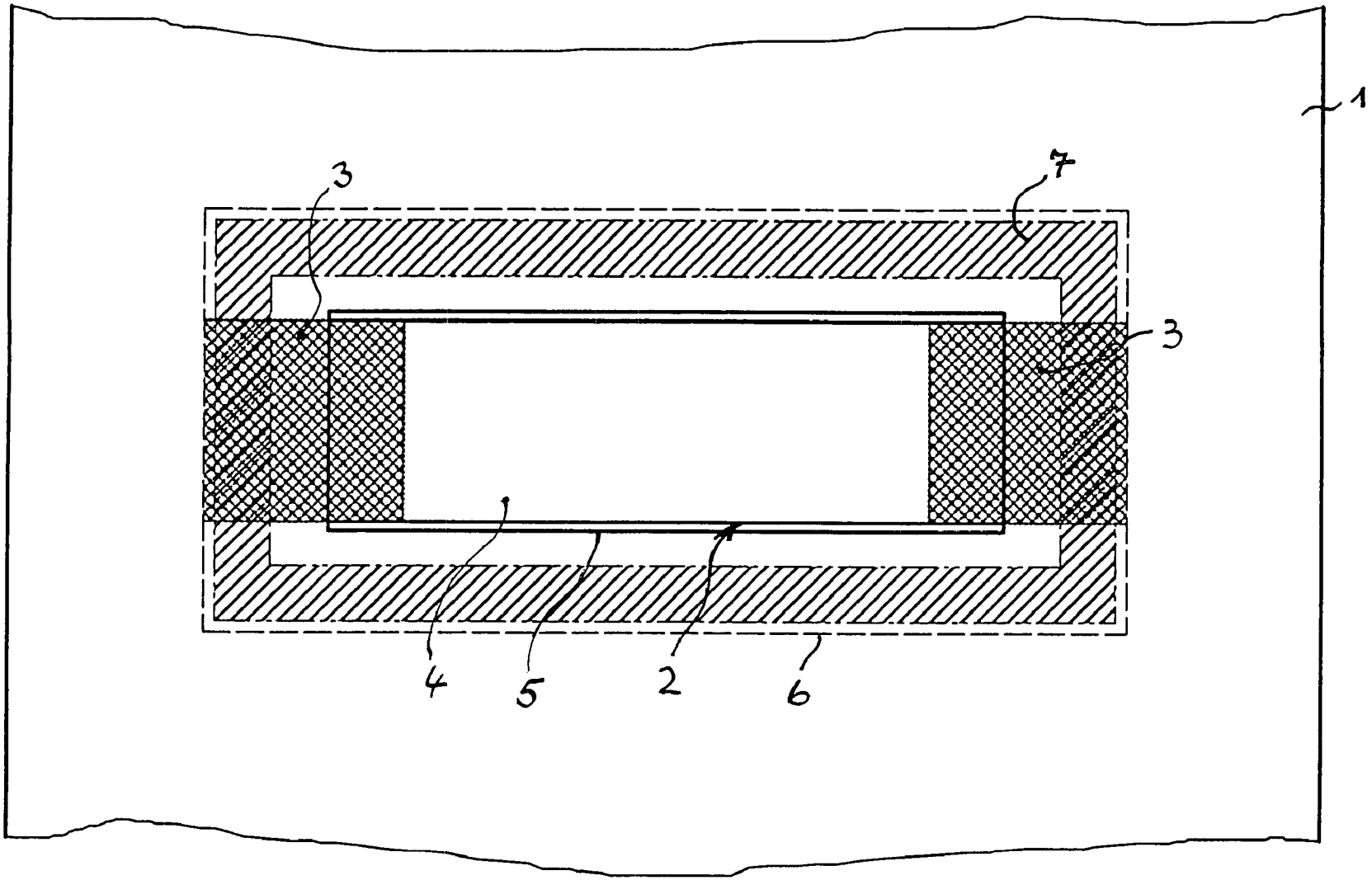

In the configuration according to FIG. 3, the strap handle 2 is attached to the inner side of the container wall 1 and is accessible from the exterior through a matched access opening 5 in the container wall 1. In this connection, the strap handle 2 is attached to a support patch 6 made of plastic film, that is positioned on the rear side of the strap handle 2 and connected to the container wall 1. Preferably, the support patch 6 is connected continuously along its outer edges to the inner side of the container wall 1 so that in this way the access opening 5 is closed relative to the interior of the container.

The support patch 6 is comprised expediently of thermoplastic plastic film that can be continuously glued to the strap handle 2 wherein, however, in the area of the handle loop portion 4 of the strap handle 2 the adhesive force is reduced by a release coating applied to the carrying patch 6 such that the handle loop portion 4 can be separated without difficulties from the support patch 6. Only within the two end areas the adhesive 3 provides a fixed connection, respectively. In a preferred embodiment of the container comprised of a plastic material composite film with an inner layer of heat-sealable thermoplastic plastic material, in particular, polyethylene (PE), and with an outer layer of polyester (PET), the support patch 6 is preferably attached to the inner side of the container wall 1 by heat sealing, as is illustrated by the cross-hatched heat seal seam 7.

The strap handle 2 itself can be comprised of thermoplastic plastic film or a composite film comprised of a thermoplastic plastic material and a polyester. Therefore, there is also the possibility to connect the support patch 6 and the strap handle 2 to one another by heat sealing.

In the embodiment of the carrying handle according to FIG. 3, the handle loop portion 4 of the strap handle 2 is visible through the access opening 5 which is matched with regard to its dimensions to the handle loop portion 4 of the strap handle 2 and, as needed, can be gripped for carrying purposes.

Figure 4:
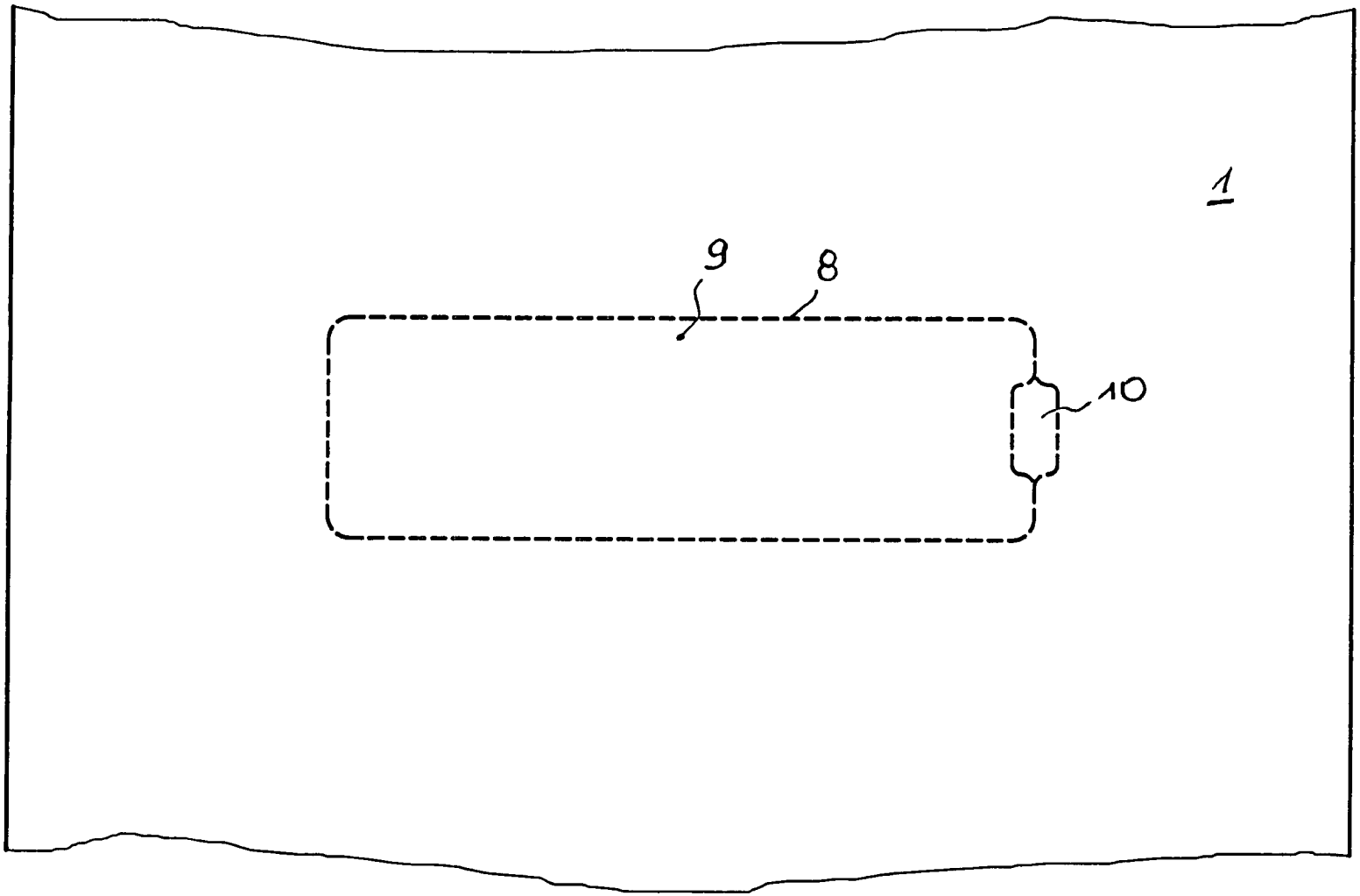

In the embodiment according to FIG. 4, the access opening 5 for the strap handle 2 is prepared in the container 1 by a perforation line 8 and is releasable only after tearing open the perforation line 8 of the wall area 9. For facilitating the tearing action of the wall area 9 to be torn, a grip opening 10 can be provided that is stamped out when applying the perforation line 8.

Figure 6:
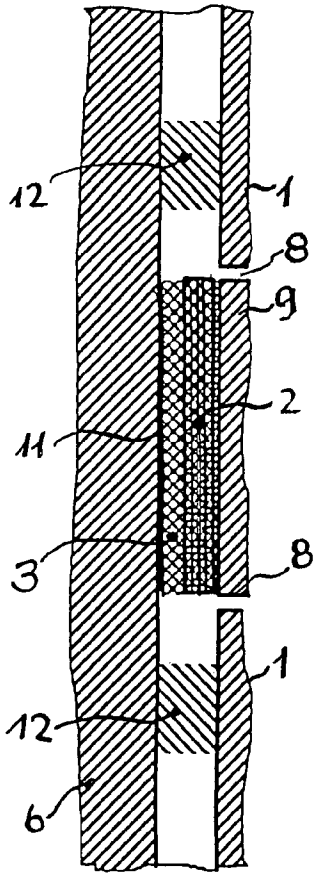
Figure 5:
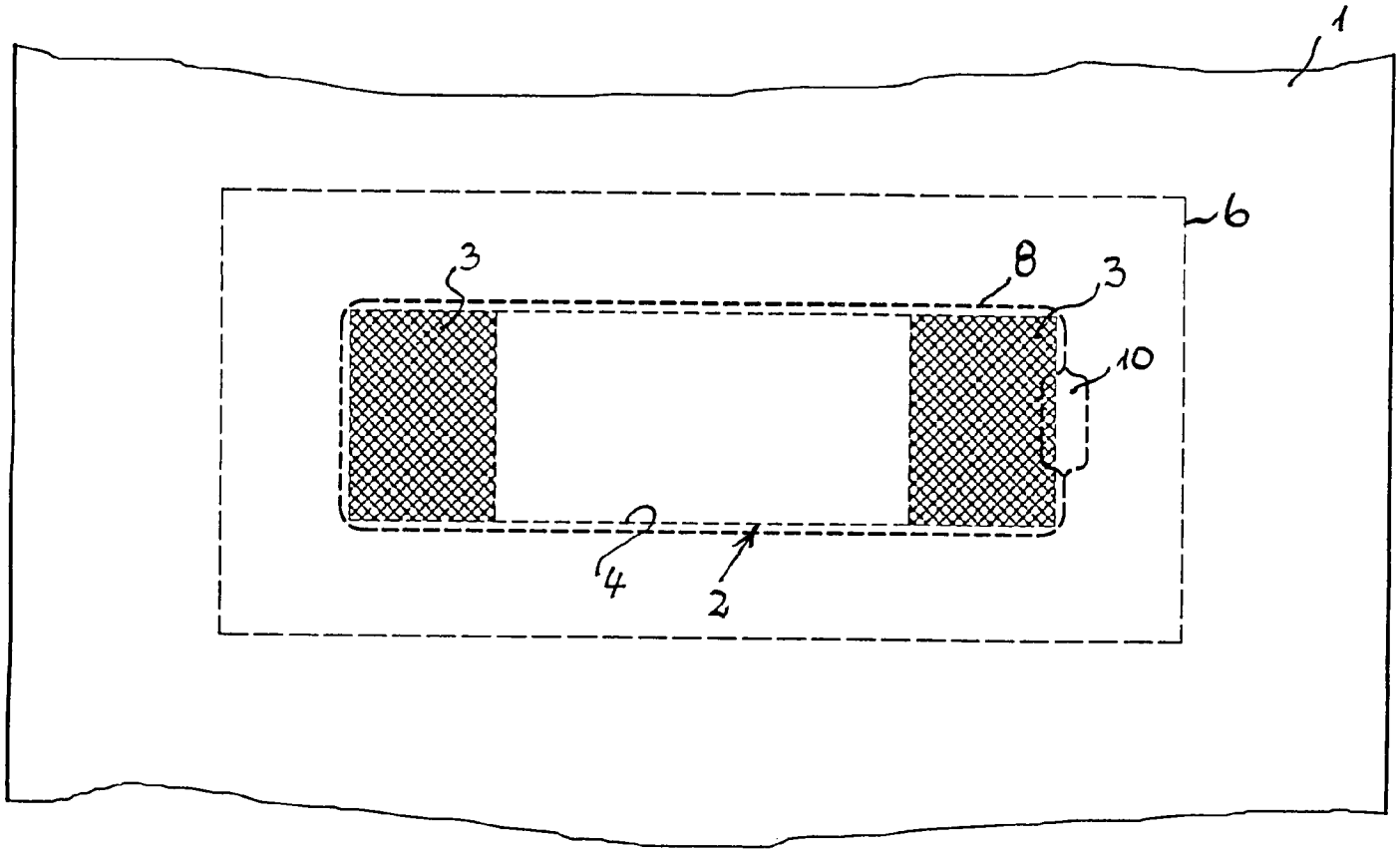

Accordingly, as illustrated in FIGS. 5 and 6, the strap handle 2 is hidden completely behind the container wall 1 until the wall area 9 surrounded by the perforation line 8 is removed by tearing it off and the access opening 5 is released. In this embodiment, the end areas of the strap handle 2 are also fixedly connected by an adhesive 3 to the support patch 6.

Figure 7:
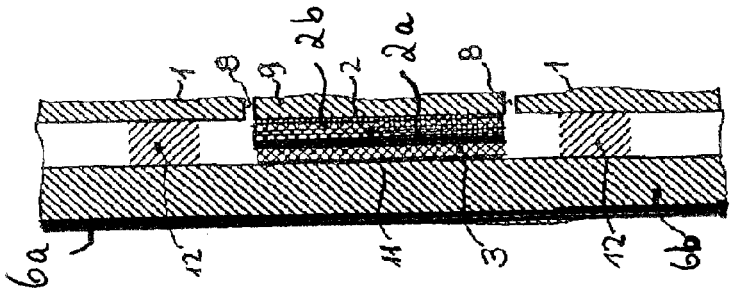
FIG. 7 shows schematically a section through a two-layer container wall and two-layer strap handle.
Figure 8:
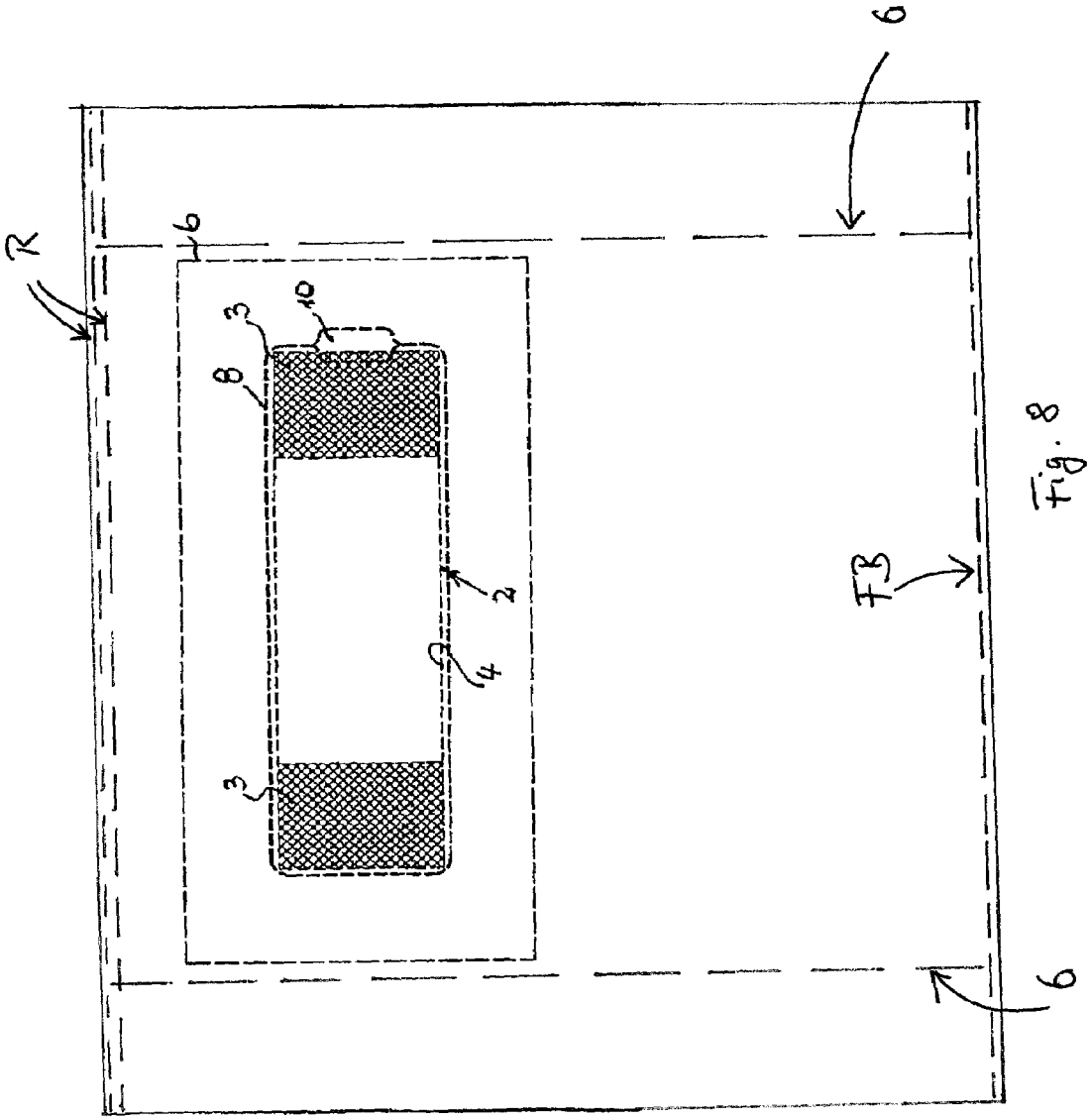
FIG. 8 shows schematically a reclosable gusset container with stand-up bottom.

In the embodiment according to FIGS. 5 and 6, the support patch 6 is connected to the inner side of the container 1, for example, by gluing, as is illustrated by the adhesive areas 12. FIG. 7 illustrates schematically a cross-section of a container wall with inner and outer layers 6*a*, 6*b* and a strap handle 2 comprised of composite film (thermoplastic material and polyester 2*a*, 2*b*). FIG. 8 shows schematically a container with a strap handle arrangement as shown in FIG. 5, wherein the container has gussets G, a stand-up flat bottom FB and is reclosable (schematically indicated by known reclosable strips R).

Finally, it should be noted that the illustration of the container in the drawing only schematically illustrates the actual situation. In particular, the thickness dimensions of the films and of the adhesive areas are greatly enlarged for illustration purposes. In real containers, they are within the range of μm.

What is claimed is:

1. A packaging container made of plastic film, the packaging container comprising:

a strap handle arranged within a contour of the container;

a container wall made of plastic film;

wherein the container wall has an inner side and the strap handle is arranged on the inner side;

wherein the container wall has an access opening through which access opening the strap handle is accessible from an exterior of the container;

a support patch made of plastic film and connected with a first face to the inner side of the container wall;

wherein the strap handle is comprised of a first end and a second end, the first and second ends glued or attached by a heat seal seam to the first face of the support patch, and further comprised of a handle loop part that extends from said first end to said second end, wherein said handle loop part with its entire length from said first end to said second end rests flat without being folded on the support patch;

wherein the access opening is closed off relative to an interior of the container by the support patch and the interior remains sealed by the support patch when the strap handle is in use.

2. The container according to claim 1, wherein the support patch has outer edges connected continuously to the inner side of the container wall.

3. The container according to claim 1, wherein a contour of the access opening is prepared by a perforation line and the access opening is releasable by tearing open a wall area of the container wall surrounded by the perforation line.

4. The container according to claim 3, wherein a grip opening for facilitating gripping of the wall area to be torn off is provided.

5. The container according to claim 1, wherein the container wall is comprised of a composite film comprising an inner layer comprised of heat-sealable thermoplastic plastic material and comprising an outer layer comprised of polyester.

6. The container according to claim 5, wherein the polyester is PET (polyethylene terephthalate) and wherein the heat-sealable thermoplastic plastic material is polyethylene.

7. The container according to claim 1, wherein the strap handle is comprised of a thermoplastic plastic film or a composite film that is made of thermoplastic plastic material and a polyester.

8. The container according to claim 1, wherein the support patch is connected to an inner layer of the container wall by a heat seal seam.

9. The container according to claim 1, embodied as a bag having an upper end that is reclosable, wherein the strap handle is arranged near the upper end.

10. The container according to claim 9, having gussets and a stand-up bottom.

11. The container according to claim 9, having gussets.

12. The container according to claim 9, having a stand-up bottom.

13. A packaging container made of plastic film, the packaging container comprising:

a strap handle arranged within a contour of the container;

a container wall made of plastic film;

wherein the container wall has an inner side and the strap handle is arranged on the inner side;

wherein the container wall has an access opening through which access opening the strap handle is accessible from an exterior of the container;

a support patch made of plastic film and connected to the container wall;

wherein the access opening is closed off relative to an interior of the container by the support patch;

wherein the support patch is made of thermoplastic plastic film and wherein the strap handle is continuously glued to the support patch, wherein the strap handle has a handle loop part and wherein an adhesive force between the handle loop part and the support patch is greatly reduced by applying a release coating to the support patch in comparison to an adhesive force between ends of the strap handle and the support patch.

* * * * *